US005137481A

United States Patent [19]

Wengler

[11] Patent Number: 5,137,481

[45] Date of Patent: Aug. 11, 1992

[54] OUTBOARD MOTOR TOTE

[76] Inventor: James J. Wengler, 2328 Monroe St. NE., Minneapolis, Minn. 55418

[21] Appl. No.: 698,787

[22] Filed: May 13, 1991

[51] Int. Cl.[5] ..... B65D 85/68

[52] U.S. Cl. ..... 440/77; 150/157; 206/319; 294/146; 440/900

[58] Field of Search ..... 440/76, 77, 113, 900; 150/157; 294/141, 146, 149, 153, 155, 157, 165; 206/319

[56] References Cited

U.S. PATENT DOCUMENTS

| | | | |
|---|---|---|---|
| 187,716 | 2/1877 | Kirk | 294/165 |
| 799,793 | 9/1905 | Kinsella | 294/155 |
| 2,434,784 | 1/1948 | Bardin | 150/157 |
| 2,475,135 | 7/1949 | Haven | 150/157 |
| 2,498,113 | 2/1950 | Milner | 150/157 |
| 2,541,449 | 2/1951 | Vickers | 294/149 |
| 2,575,749 | 11/1951 | Cross | 206/319 |
| 3,172,586 | 3/1965 | Lu | 224/55 |
| 4,114,838 | 9/1978 | Knauf | 224/45 S |
| 4,469,363 | 9/1984 | Kalla | 294/154 |
| 4,556,245 | 12/1985 | Gruenwald | 294/31.2 |
| 4,828,310 | 5/1989 | Schmidt et al. | 294/153 |

FOREIGN PATENT DOCUMENTS

| | | | |
|---|---|---|---|
| 747280 | 1/1944 | Fed. Rep. of Germany | 440/113 |

*Primary Examiner*—Sherman D. Basinger
*Assistant Examiner*—Thomas J. Brahan
*Attorney, Agent, or Firm*—James V. Harmon

[57] ABSTRACT

An outboard motor carrier or tote includes at least a pair of spaced apart straps that encircle the motor in planes which are spaced apart from one another and a carrying handle formed from fabric, e.g. nylon webbing that is formed into an endless loop which encircles the straps and extends below an upper portion of each strap. Straps are preferably connected to the loop handle, e.g. by being sewn to it. Each of the straps has a releasable fastener for securing its ends together so that the straps are located in upright, longitudinally spaced apart planes, preferably forward and rearward planes located respectively at the front and rear of the motor. An optional cover encloses the upper aspect of the motor and includes downwardly depending side portions adjacent the left and right sides of the motor. The side portions of the cover are preferably provided with upwardly opening pockets for holding parts, tools and the like. The cover can also be used to support a post which extends upwardly and has a 360° white navigation light at its upper end.

18 Claims, 2 Drawing Sheets

OUTBOARD MOTOR TOTE

FIELD OF THE INVENTION

The invention relates to outboard motors and particularly to a device used to facilitate the lifting and transporting of the motor.

BACKGROUND OF THE INVENTION

Numerous devices have been previously employed for carrying various objects. For example, it has been proposed in U.S. Pat. No. 4,828,310 to carry packages with straps secured to a handle assembly that includes reels for winding up the straps. U.S. Pat. No. 4,114,838 describes a carrier for skis and ski poles that includes Velcro® covered strap members which encircle the skis. Firewood can be lifted with a carrier described in U.S. Pat. No. 4,469,363. U.S. Pat. No. 4,556,254 describes a carrier for a diving tank or other cylindrical object that can be carried by means of a pair of spaced straps having a connecting handle. In this carrying assembly there is no positive means of spacing the straps at a predetermined distance from one another. U.S. Pat. No. 3,172,586 describes a carrier for books. However, in this device the carrying handle is connected to the center portion of a rigid plate while the book straps are connected to end portions of the plate located outwardly from the handle.

While these prior carrying systems are suitable for a variety of objects, an outboard motor presents at least two special problems. It is a general objective of the invention to provide a carrier for more easily and safely mounting and removing a motor from a boat, e.g. a dinghy, even in a difficult situation such as when the motor and dinghy are substantially below the elevation of the dock.

Another object is to allow one person to more easily and quickly remove or replace an outboard motor on a boat.

A further object is to help stabilize an unwieldy motor when it is being mounted on or removed from the transom of a boat.

It was discovered that it is important to provide a secure support point in the form of a lifting handle at the top of the motor housing. However, with the handle secured at this point, it was found that initially the straps would not encircle the forward and rearward ends of the motor housing and yet conform closely to the contours of the housing. It is therefore an object to provide good strap conformity.

Another important object is to find a reliable way of providing a strong connection between the handle and the pair of strap members that are used to surround the outboard motor housing.

Another object is to have a provision for enclosing the upper aspect of the motor to protect it from the the elements and from abrasion and to provide a way of storing tools, spare parts, fishing gear and, optionally, for supporting an electric light.

It is also an object of the present invention to provide a carrier or tote for an outboard motor in which the lifting force applied to the handle is transferred directly to straps that pass around the motor housing.

Another object of the invention is the provision of an outboard motor tote in which a front carrying strap is secured to the handle in such a way that it projects forwardly at an oblique angle from the forward end of the handle and a rear strap which projects rearwardly at an oblique angle from the point where it is attached to the handle.

SUMMARY OF THE INVENTION

This invention provides an outboard motor carrier or motor tote including at least a pair of spaced apart straps for encircling the motor in upright planes which are spaced apart from one another and a carrying handle formed from webbing into an endless loop that encircles the straps and extends below an upper portion of each strap. The straps are preferably connected to the loop handle, e.g. by being sewn thereto. Each of the straps has a releasable fastener for securing its ends together so that when in place on the motor the front and rear straps are located in two upright, longitudinally spaced apart planes. An optional cover encloses the upper aspect of the motor and includes downwardly depending side portions which cover the left and right sides of the motor housing. The side portions of the cover are preferably provided with upwardly opening pockets for holding spare parts, tools, fishing gear and the like. The cover can also be used to support a post which extends upwardly and includes an electric lamp to provide a light at its upper end.

These and other more detailed and specific objects of the invention will be apparent in view of the following specification and figures which illustrate by way of example but a few of the various forms of the present invention that will be apparent to those skilled in the art within the scope of the appended claims.

THE FIGURES

DETAILED DESCRIPTION OF THE INVENTION

Referring now to the figures, there is shown an outboard motor carrier assembly and cover indicated generally at 10 which includes a pair of motor support straps 12 and 14 to which is secured a handle 16 in the form of a loop that encircles the upper aspect of the straps 12 and 14, and a cover 18 formed from flexible sheet material such as canvas or the like.

Figure 1:
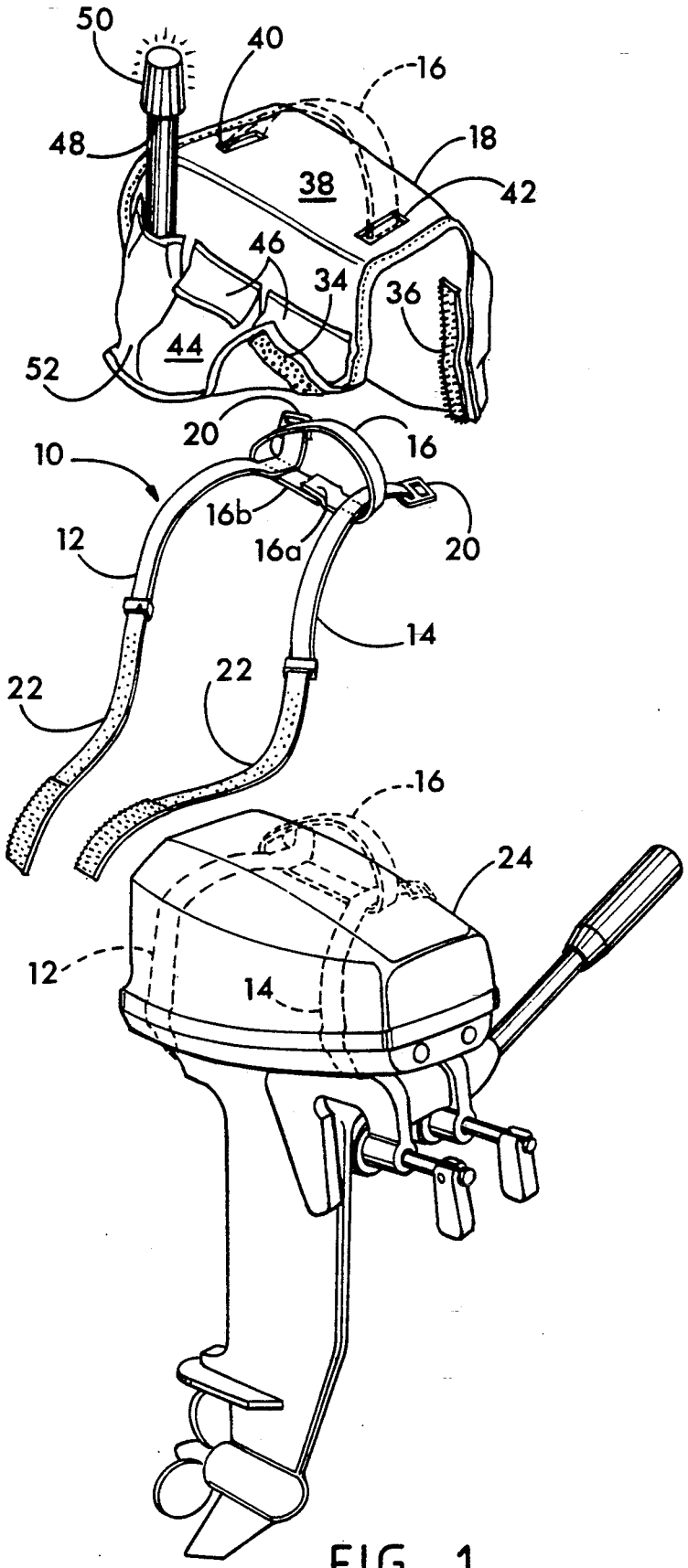
FIG. 1 is an exploded perspective view of an outboard motor carrier system in accordance with the invention.
Figure 2:
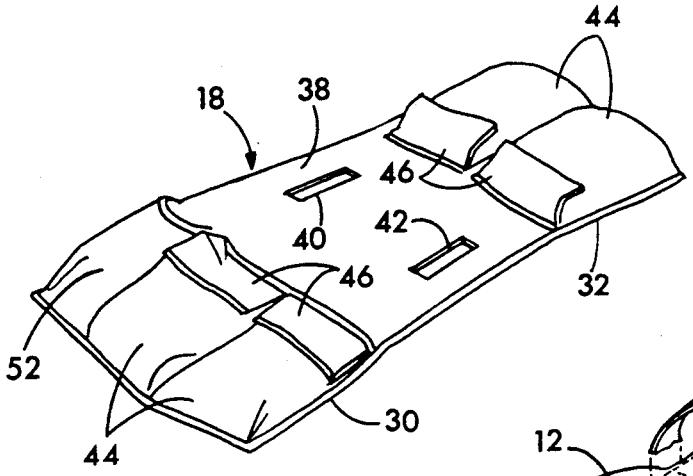
FIG. 2 is a perspective view of the cover as it appears when laid out flat.

The straps and handle assembly 12–16 will now be described in more detail with reference to FIGS. 1, 3 and 4.

Figure 4:
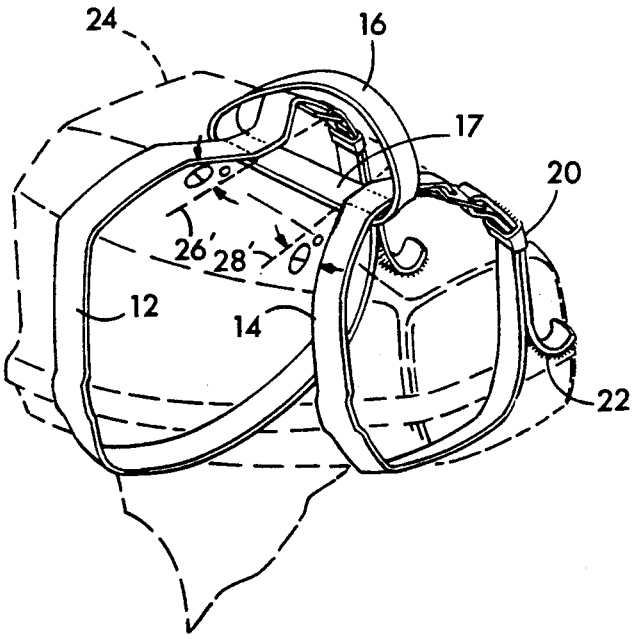
FIG. 4 is a perspective view of the carrying assembly as it appears when mounted on a motor.

As shown in the figures, each of the straps 12 and 14 includes a buckle 20 at one end and, optionally, additional connecting means such as hook and loop (Velcro®) fasteners 22 on the surface of each strap so that when the straps 12 and 14 are positioned to encircle the housing 24 of an outboard motor in longitudinally spaced apart upright planes, the straps can be tightened by bringing the free ends through the buckles 20 and then securing the hook and loop fasteners 22 to one another as shown in FIG. 4 so that each strap tightly and securely engages the motor housing 24. Both the straps 12, 14 and handle 16 are preferably formed from straps of flexible material such as nylon webbing. If the straps 12, 14 are one and one-half inches wide, the Velcro® strips 22 should be about eight inches long.

The handle 16 is formed from fabric, e.g. nylon webbing or other suitable strap material. The handle 16 is positioned to extend around the upper aspect of each of the straps 12 and 14 with ends 16*a* and 16*b* brought together in overlapping relationship as shown in FIG. 3 and sewn together to form a loop encircling straps 12 and 14. The handle 16 in this way provides a structural holding point on top of the motor housing 24. The handle loop 16 and its connection to the straps 12 and 14 provides a very strong support point at the top of the motor housing 24 that becomes the fulcrum for lifting, directing and positioning or controlling the weight of the motor, particularly under difficult conditions, e.g. when the boat is unstable because it is rolling or pitching.

Positioned above the lower portion of the loop of the handle 16 is a stiff reinforcing plate 26 that can be formed from any strong material such as fiber-reinforced plastic, e.g. a fiberglass batten, metal or the like. The stiff reinforcing plate 26 is preferably enclosed beneath a fabric cover strip 28 which is sewn along its edges to the lower portion of the handle 16 to enclose the plate 26 between itself and the lower portion 17 of the loop handle 16. It will be noted that the ends of the reinforcing plate 26 also extend beneath the straps 12 and 14, thereby helping to support the straps 12, 14 when the handle 16 is lifted. The plate 26 provides rigidity for the handle 16 and keeps the straps 12, 14 in a selected position relative to one another as well as absorbing compressive loads imposed by lifting the handle 16.

Figure 3:
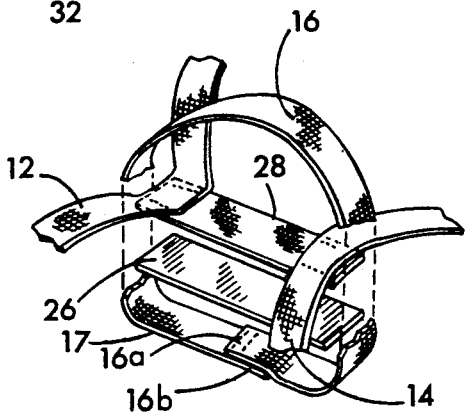
FIG. 3 is an exploded view of the upper portion of the straps and carrying handle.

As shown best in FIGS. 3 and 4, the straps 12 and 14 intersect the handle 16 at an oblique angle $\theta$. To be more specific, the rear strap 12 is raked rearwardly at an angle $\theta$ to a line 26' extending transversely, i.e. at right angles to the handle 16. Similarly, the front strap 14 is raked forwardly at an angle $\theta$ to a transverse axis 28' that extends at right angles to the handle 16. The proper angle between the straps 12, 14 and the handle 16 can be achieved by supporting the straps 12, 14 at the desired angle while they are being sewn to the handle 16. The angle $\theta$ is typically between about 10° and 20°, and preferably about 15°. The oblique orientation of the straps 12, 14 with respect to the handle 16 enables the straps 12, 14 to lay flat against the outboard motor housing 24 and to encircle the forward and rearward portions of the motor.

The cover 18 is formed from a flexible sheet of material, e.g. a suitable fabric such as canvas, of rectangular shape and includes a pair of side panels 30 and 32 which depend downwardly along each side of the motor housing 24. Each of the freely hanging side panels 30, 32 can be secured to the straps 12 and 14 by means of removable connectors such as hook and loop (Velcro®) fasteners 34 and 36 which bond to underlying Velcro®-covered sections of the straps 12 and 14 so as to retain the cover 18, including the side panels 30 and 32, securely in place on the motor. The center section 38 of the cover 18 encloses the top portion of the motor housing 24. A pair of longitudinally spaced apart openings 40 and 42 accommodates the handle 16. Placed on each of the side panels 30, 32 are upwardly opening pockets 44. The pockets 44 can be used to hold tools, spare parts or other devices, such as a security device (not shown) to prevent theft of the motor, or VHF radio, depth sounder, speedometer or knot meter and other navigation aids. The open ends of the pockets 44 can be covered by means of cover flaps 46 which are optionally held in place by suitable fasteners such as buttons or other fasteners, e.g. Velcro®.

Secured to one side of the cover 18 is an elongated upright post 48 which projects upwardly a substantial distance, usually about 6 inches to 10 inches, above the upper surface 38 of the cover 18 and includes an electric lamp 50 at its upper end to provide a 360° white navigation running light as well as providing for illuminating the area around the motor housing 24. The post 48 can enclose batteries for powering the lamp 50 and can be connected to the cover 18 in any suitable way, e.g. by being slid telescopically into a tubular sleeve 52, for example, at the right side flap 30. If desired, the cover 18 can be made of clear plastic or partially of clear plastic to house maps or charts, guidebooks, pocket knife, integrated fishing tackle kit and the like. It will be noted that the cover 18 is open at the front, thus allowing the engine controls to be exposed.

It will be seen that in this way the flexible handle loop 16 encircles the straps 12, 14 to provide a very secure connection between them. In addition, the reinforcing plate 26 will maintain a predetermined spacing between the upper aspect of the straps 12 and 14 and will strengthen the connection between the handle loop 16 and the straps 12, 14.

Figure 5:
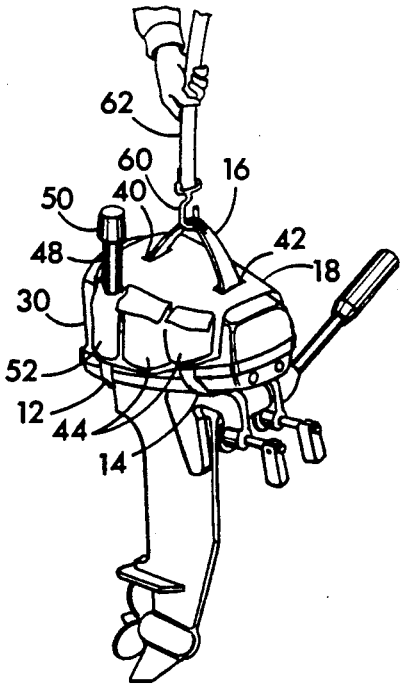
FIG. 5 is a perspective view of the carrier system and motor after being assembled with the motor cover in place.

During use, the handle 16 can be lifted manually by grasping it with a hand or, if desired, the handle 16 can be engaged by a suitable lifting implement (FIG. 5) such as a hook 60 secured to the end of a rope 62, a cord or a lanyard.

It was found that the motor carrier in accordance with the present invention is highly effective in allowing a heavy outboard motor to be easily and more safely removed and replaced on a boat. The invention has proved to be particularly useful to fisherman, boaters and yachtsmen who must remove the outboard motor from a boat such as a dinghy on a regular basis. The invention makes this operation more safe and easier to perform while at the dock. The invention is easily manufactured from readily available materials and can be produced inexpensively in large numbers.

Many variations of the present invention within the scope of the appended claims will be apparent to those skilled in the art once the principles described above are understood.

What is claimed is:

1. An outboard motor tote comprising, an elongated rear strap for encircling the stern portion of an outboard motor housing and adapted to be positioned in an upright plane passing through a rear portion of the motor housing, a front strap adapted to encicle a forward part of the motor housing and, when mounted, being positioned in an upright plane spaced apart from the rear strap and positioned forwardly thereof, a handle connected to a top portion of each of the straps, said handle projecting upwardly from the top portion of the straps to provide a hand opening between itself and the outboard motor housing sufficiently large for insertion of a person's hand for lifting the motor and releasable fastener means for securing each of the straps in place upon the motor whereby the motor tote can be removed from the motor by releasing the straps and can be remounted as required by the user, a cover formed from flexible sheet material is releasably secured to at least one of said straps as a part of the motor tote for extending across and covering the upper aspect of the motor housing when the straps are in place thereon.

2. The outboard motor tote of claim 1 wherein the cover is formed from fabric and includes at least one upwardly opening pocket for carrying articles.

3. The outboard motor tote of claim 1 wherein the motor tote has secured thereto a post positioned thereon to project upwardly when the tote is mounted on the motor housing, said post having an electrically powered navigation lamp at its upper end.

4. An outboard motor tote comprising, an elongated rear strap for encircling the stern portion of an outboard motor housing and adapted to be positioned in an upright plane passing through a rear portion of the motor housing, a front strap adapted to encircle a forward part of the motor housing and, when mounted, being positioned in an upright plane spaced apart from the rear strap and positioned forwardly thereof, a handle connected to a top portion of each of the straps, said handle projecting upwardly from the top portion of the straps to provide a hand opening between itself and the outboard motor housing sufficiently large for insertion of a person's hand for lifting the motor and releasable fastener means for securing each of the straps in place upon the motor whereby the motor tote can be removed from the motor by releasing the straps and can be remounted as required by the user, the motor tote is an assembly comprising two components including an upper flexible sheet cover portion adapted to extend over the upper aspect of the motor when the tote is mounted thereon to serve as a cover therefor, and said flexible sheet cover portion has a pair of openings therein through which said handle extends.

5. The outboard motor tote of claim 4 wherein the flexible sheet cover is removably connected to the straps.

6. The outboard motor tote of claim 5 wherein the removable connection of the flexible sheet cover to the straps comprises a Velcro ® connection therebetween.

7. The outboard motor tote of claim 4 wherein the cover has a pair of downwardly depending upright sidewall portions and each of the sidewall portions includes at least a pair of upwardly opening pockets, said pockets having cover flaps with a provision for temporarily fastening the cover flaps in place.

8. The outboard motor tote of claim 7 wherein the cover has secured thereto an upright post positioned to extend upwardly therefrom to an elevation that is above the upper surface of the motor tote when mounted upon the motor and said post has an electrically powered lamp at its upper end.

9. A combination of a removable motor tote and an outboard motor comprising, (1) an outboard motor having a motor housing, said motor housing having a top surface, (2) a motor tote assembly having strap means at least partially encircling the housing of the motor and being connected thereto, (3) handle means connected to the strap means in the vicinity of the top surface of the motor housing, (4) the handle means has portions connected to the strap means so that the handle is positioned above the top surface of the motor housing to provide a support point at the top of the motor housing which serves as a fulcrum for lifting, directing and positioning or controlling the weight of the motor, (5) said strap means when mounted upon the motor locating the handle in a position projecting away from the top surface of the motor housing whereby the handle can be grasped with the hand or with a lifting implement placed above the top surface of the motor housing for raising and lowering the motor, (6) said strap means having an elongated rear strap for encircling the stern portion of the outboard motor housing and adapted to be positioned in an upright plane passing through a rear portion of the motor housing, a front strap adapted to encircle a forward part of the motor housing and, when mounted, being positioned in an upright plane spaced apart from the rear strap and positioned forwardly thereof, the handle means being connected to a top portion of each of the straps, said handle means projecting upwardly from the top portion of the straps to provide a hand opening between itself and the outboard motor housing sufficiently large for insertion of a person's hand for lifting the motor, and releasable fastener means for securing each of the straps in place upon the motor, whereby the motor tote can be removed from the motor by releasing the straps, and can be remounted as required by the user.

10. A combination of a motor tote and an outboard motor comprising, an outboard motor having a motor housing, a motor tote assembly having strap means at least partially encircling the housing of the motor and handle means connected to the strap means in the vicinity of a top portion of the motor housing for lifting the motor, said strap means when mounted upon the motor being adapted to locate the handle in a position projecting away from a surface of the motor whereby the handle can be grasped with the hand or with a lifting implement for raising and lowering the motor and a cover formed from flexible sheet material releasably secured to at least one of said straps for extending across and covering the upper aspect of the motor when the straps are secured in place thereon.

11. A combination of a motor tote and an outboard motor comprising, an outboard motor having a motor housing, a motor tote assembly having strap means at least partially encircling the housing of the motor and handle means connected to the strap means in the vicinity of a top portion of the motor housing for lifting the motor, said strap means when mounted upon the motor being adapted to locate the handle in a position projecting away from a surface of the motor whereby the handle can be grasped with the hand or with a lifting implement for raising and lowering the motor and the motor tote includes an upright, upwardly projecting post having an electrically powered lamp at its upper end.

12. A combination of a motor tote and an outboard motor comprising, an outboard motor having a motor housing, a motor tote assembly having strap means at least partially encircling the housing of the motor and handle means connected to the strap means in the vicinity of a top portion of the motor housing for lifting the motor, said strap means when mounted upon the motor being adapted to locate the handle in a position projecting away from a surface of the motor whereby the handle can be grasped with the hand or with a lifting implement for raising and lowering the motor, the motor tote is an assembly comprising two components including an upper flexible cover sheet portion adapted to extend over the upper aspect of the motor when the tote is mounted thereon, and said flexible sheet cover portion has a pair of openings therein through which the handle extends when the cover is secured to the straps.

13. The article of claim 12 wherein the cover has a pair of downwardly depending upright sidewall portions and each of the sidewall portions includes at least a pair of upwardly opening pockets, said pockets have cover flaps for closing the pockets with a provision for temporarily fastening the cover flaps in place.

14. The article of claim 12 wherein the cover has secured thereto an upright post positioned to extend upwardly therefrom to an elevation above an upper surface of the motor tote when mounted upon the motor and said post has an electrically powered lamp at its upper end.

15. A combination of a motor tote and an outboard motor comprising, an outboard motor having a motor housing, a motor tote assembly having strap means at least partially encircling the housing of the motor and handle means connected to the strap means in the vicinity of a top portion of the motor housing for lifting the motor, said strap means when mounted upon the motor being adapted to locate the handle in a position projecting away from a surface of the motor whereby the handle can be grasped with the hand or with a lifting implement for raising and lowering the motor, the strap means comprises a pair of longitudinally spaced apart strap assemblies adapted to encircle a front portion and a rear portion of the outboard motor housing and to be located in horizontally spaced apart upright planes, a rigid reinforcing plate is connected between an upper portion of each of the straps and said handle is connected to the reinforcing plate so as to project upwardly therefrom to provide a hand opening between the reinforcing plate and an upper portion of the handle.

16. The article of claim 15 wherein the handle is a strap of webbing material having end portions secured together to form an endless loop which encircles the straps, a lower portion of the endless loop is connected to the reinforcing plate and the endless loop handle extends upwardly from the reinforcing plate at a pair of spaced apart points located at each end of the reinforcing plate to form a hand opening between an upper portion of the handle and the reinforcing plate.

17. The article of claim 16 wherein the handle is formed from a fabric webbing and the straps encircle the motor housing so as to locate the handle at the top of the motor housing when the motor is in an upright position, said straps intersect transverse axes at selected angles such that a rear strap projects rearwardly from the handle at an oblique angle and the forward strap projects forwardly from the handle at an oblique angle whereby the strap lie flat against the motor housing when tightened in a position encircling the housing.

18. The article of claim 16 wherein the handle, the reinforcing plate and straps are sewn together to form a tote assembly that encircles the outboard motor during use for locating the handle at the top of the motor housing when the motor is in an upright position.

* * * * *